US010812902B1

(12) United States Patent
Abel et al.

(10) Patent No.: US 10,812,902 B1
(45) Date of Patent: Oct. 20, 2020

(54) SYSTEM AND METHOD FOR AUGMENTING AN ACOUSTIC SPACE

(71) Applicant: The Board of Trustees of the Leland Stanford Junior University, Stanford, CA (US)

(72) Inventors: Jonathan S. Abel, Menlo Park, CA (US); Eoin F. Callery, Mountain View, CA (US); Elliot Kermit Canfield-Dafilou, Mountain View, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 0 days.

(21) Appl. No.: 16/442,386

(22) Filed: Jun. 14, 2019

Related U.S. Application Data

(60) Provisional application No. 62/685,739, filed on Jun. 15, 2018.

(51) Int. Cl.

| | |
|---|---|
| ***H04R 3/02*** | (2006.01) |
| ***H04S 7/00*** | (2006.01) |
| ***H04R 3/04*** | (2006.01) |
| ***H04R 5/02*** | (2006.01) |

(52) U.S. Cl.
CPC ..... *H04R 3/02* (2013.01); *H04R 3/04* (2013.01); *H04R 5/02* (2013.01); *H04S 7/307* (2013.01)

(58) Field of Classification Search
USPC ..... 381/56, 83, 93, 94.1, 95, 121, 306, 309
See application file for complete search history.

(56) References Cited

U.S. PATENT DOCUMENTS

| | | | | |
|---|---|---|---|---|
| 10,237,649 | B2 * | 3/2019 | Nongpiur | H04R 3/005 |
| 10,283,106 | B1 * | 5/2019 | Saeidi | G10K 11/17853 |
| 2014/0003611 | A1 * | 1/2014 | Mohammad | H04R 3/005 381/66 |
| 2017/0223478 | A1 * | 8/2017 | Jot | H04S 1/005 |
| 2018/0135864 | A1 * | 5/2018 | Hanazono | F24C 15/2021 |

* cited by examiner

*Primary Examiner* — Yosef K Laekemariam
(74) *Attorney, Agent, or Firm* — Foley & Lardner LLP

(57) ABSTRACT

A method and system for real-time auralization is described in which room sounds are reverberated and presented over loudspeakers, thereby augmenting the acoustics of the space. Room microphones are used to capture room sound sources, with their outputs processed in a canceler to remove the synthetic reverberation also present in the room. Doing so gives precise control over the auralization while suppressing feedback. It also allows freedom of movement and creates a more natural acoustic environment for performers or participants in music, theater, gaming, home entertainment, and virtual reality applications. Canceler design methods are described, including techniques for handling varying loudspeaker-microphone transfer functions such as would be present in the context of a performance or installation.

16 Claims, 14 Drawing Sheets

SYSTEM AND METHOD FOR AUGMENTING AN ACOUSTIC SPACE

CROSS-REFERENCE TO RELATED APPLICATIONS

The present application claims priority to U.S. Provisional Patent Application No. 62/685,739 filed Jun. 15, 2018, the contents of which are incorporated herein by reference in their entirety.

TECHNICAL FIELD

The present embodiments relate generally to the field of audio signal processing, particularly to artificial reverberation and simulating acoustic environments.

BACKGROUND

Acoustic enhancement and adjustment technology has been used in many music and theatrical settings, as well as in virtual reality and film audio applications, to simulate desired acoustic spaces. For example, a concert of Byzantine music written as early as the twelfth century for the reverberant Hagia Sophia in Istanbul can be performed using acoustic enhancement technology to simulate the 12-second-long reverberation of Hagia Sophia in the Bing Concert Hall at Stanford University, which otherwise has a 2.4-second-long reverberation time.

Computational methods for simulating reverberant environments are well developed (e.g., Vesa Valimaki, et al., "Fifty years of artificial reverberation," IEEE Trans. Audio, Speech, and Lang. Proc., Vol. 20, No. 5, July 2012, hereinafter [1]; Michael Vorländer, Auralization: Fundamentals of Acoustics, Modelling, Simulation, Algorithms and Acoustic Virtual Reality, Springer, 2007, hereinafter [2]; and Mendel Kleiner et al., "Auralization—an overview," Journal of the Acoustical Society of America, vol. 41, no. 11, pp. 861-75, November 1993, hereinafter [3]) and these so-called auralization systems process sound sources according to impulse responses encapsulating the acoustics of the desired space, and render them over loudspeakers in the venue. In music recording, rehearsal and performance applications, real-time processing is needed to capture musician interactions with the virtual space. Musicians will adjust their tempo and phrasing, alter pitch glides, and seek building resonances in response to the acoustics of the space (e.g., Gade, A. C., "Investigations of musicians' room acoustic conditions in concert halls, Part I: methods and laboratory experiments," Acta Acustica United with Acustica, 69(5), pp. 193-203, 1989, hereinafter [20]; Gade, A. C., "Investigations of musicians' room acoustic conditions in concert halls, II: Field experiments and synthesis of results," Acta Acustica Unitid with Acustica, 69(6), pp. 249-62, 1989, hereinafter [21]; Lokki, T. et al., "A Rehearsal Hall with Virtual Acoustics for Symphony Orchestras," in Proceedings of the 126th Audio Engineering Society Convention, 2009, hereinafter [22]; Ueno, K. and Tachibana, H., "Experimental study on the evaluation of stage acoustics by musicians using a 6-channel sound simulation system," Acoustical Science and Technology, 24(3), pp. 130-8, 2003, hereinafter [23]; and Canfield-Dafilou, E. K. et al., "A Method for Studying Interactions between Music Performance and Rooms with Real-Time Virtual Acoustics," in Proceedings of the 146th Audio Engineering Society Convention, 2019).

One of the main difficulties in implementing such systems is suppressing feedback that results from loudspeaker signals finding their way into microphones intended to capture "dry" source signals in the space. For instruments not affected by acoustic feedback, the instrument signal may be processed and played over loudspeakers, providing real-time auralization. The Virtual Haydn project (e.g. Beghin, T. et al., "The Virtual Haydn: Complete Works for Solo Keyboard," Naxos of America, 2009, hereinafter [24]) described this approach to record keyboard performances in nine synthesized spaces; however, during the actual recording session, the performer used headphones to hear the virtual acoustics.

To avoid feedback in the case of acoustic instruments or voice, one approach is to use close or contact microphones and statistically independent impulse responses (e.g. Abel, J. et al., "Recreation of the Acoustics of Hagia Sophia in Stanford's Bing Concert Hall for the Concert Performance and Recording of Cappella Romana," in Proceedings of the International Symposium on Room Acoustics, 2013, hereinafter [25]; Abel, J. and Werner, K., "Aural Architecture in Byzantium: Music, Acoustics, and Ritual, chapter Live auralization of Cappella Romana at the Bing Concert Hall," Stanford University, Routledge, 2017, hereinafter [26]). Doing so, while adequate for generating the acoustic signature of the simulated space, doesn't capture the direct sound with sufficient quality for recording. In addition, close or contact mics present logistical difficulties, especially in the case of a large or changing ensemble, and are not appropriate for an installation or performance in which audience members are also sound sources. Furthermore, close or contact mics don't capture the changing radiation pattern with singer or instrument movement. The use of statistically independent impulse responses by itself, however doesn't provide adequate feedback suppression, especially in the presence of very reverberant simulated spaces.

There are a number of systems that attempt to create auralizations while suppressing feedback which use many microphones and loudspeakers installed in the space. One example is Wieslaw Woszcyk et al., "Development of virtual acoustic environments for music performance and recording," in Proceedings 25th Tonmeistertagung VDT International Convention, 2008 (hereinafter [6]) which uses directional microphones pointed away from the loudspeakers to limit feedback. To further suppress feedback, the microphone signals are frequency shifted, limiting the time over which feedback can build. The drawback is that directional microphones do not provide much suppression, and are ineffective for settings in which sound sources and listeners are close to each other. Furthermore, pitch shifting signals by a sufficient amount to be effective at controlling feedback can affect the perception and performance of music (e.g. Lokki, T. et al., "Virtual Acoustic Spaces with Multiple Reverberation Enhancement Systems," in Proceedings of the 30th International Audio Engineering Society Conference, 2007).

Other existing systems use these and other techniques to achieve similar results and are installed in a variety of theatrical, conference, and educational spaces, for instance as summarized in Mark A. Poletti, "Active acoustic systems for the control of room acoustics," in Proceedings of International Symposium on Room Acoustics, 2010 (hereinafter [7]). For example, the Meyer Constellation system (e.g. Meyer Sound, "Constellation acoustic system," https://meyersound.com/product/constellation/, 2006, hereinafter [4]) uses a large number of precisely located microphones and loudspeakers, and processes captured sounds with statistically independent impulse responses. The Lexicon-LARES Associates systems (e.g. David Griesinger, "Improving room acoustics through time-variant synthetic reverberation," in Proceedings of the 90th Audio Engineering Society Convention, 1991, hereinafter [5]) also make use of a large number of loudspeakers and microphones, and employ time varying processing to avoid generating feedback.

A number of approaches have been used to suppress feedback, including adaptive notch filtering to detect and suppress individual frequencies as they initiate feedback (e.g., Shang Li et al., "Fast stabilized adaptive algorithm for iir bandpass/notch filters for a single sinusoid detection," Electronics and Communications in Japan (Part III: Fundamental Electronic Science), vol. 76, no. 8, pp. 12-24, 1993, hereinafter [8]), frequency shifting the synthesized acoustics (e.g. M R Schroeder, "Improvement of acoustic-feedback stability by frequency shifting," The Journal of the Acoustical Society of America, vol. 36, no. 9, pp. 1718-24, 1964, hereinafter [9]), varying the synthesized acoustics over time (e.g., [5]), and decorrelating the various auralization impulse responses (e.g. Mark A Poletti and Roger Schwenke, "Prediction and verification of powered loudspeaker requirements for an assisted reverberation system," in Proceedings of the 121st Audio Engineering Society Convention, 2006, hereinafter [10]; Jonathan S Abel et al., "Estimating room impulse responses from recorded balloon pops," in Proceedings of the 129th Audio Engineering Society Convention, 2010, hereinafter [11]). These systems are often expensive, permanently installed, and require prolonged calibration and tuning. To provide the needed control and to achieve the best possible performance, these systems are typically built from the ground up using proprietary hardware and software. As a result, they do not take advantage of loudspeaker and microphone arrays that might already be present at a given facility.

These proprietary systems also require costly hardware, including many loudspeakers and microphones, to create virtual or enhanced acoustic auralizations and reverberation. Preexisting speaker arrays cannot be used in conjunction with such systems, and often the architecture and structure of the site must be altered to allow installation. Additionally, these systems require a significant amount of tuning and calibration to maximize feedback suppression. Further, the current systems which require frequency shifting or adaptive notching for feedback suppression are not suitable for many live sound applications as the integrity of the non-processed signal is compromised. Moreover, these systems are designed to work in large institutional or commercial contexts and are not scalable for domestic uses such as for home cinema or gaming.

In current systems, real-time control over the synthesized acoustics is difficult and not compatible with the demands of emergent real-time augmented (AR), virtual (VR), and mixed reality (MR) technologies. In the case of home entertainment and gaming, live and virtual/augmented/mixed audio environments must be combined and realized by the use of headset. Finally, while echo cancellation—a form of feedback suppression—has been used in telephony since the late 1920's, it is not readily adapted to feedback suppression in performance or entertainment situations that seek to simulate acoustics.

Any new methods for canceling feedback of synthesized reverberation should be simpler and less costly and time consuming to install and calibrate compared with existing systems. They should also be affordable and scalable for domestic and institutional use whether in home cinema and gaming, broadcast and streaming events such as sports, or in classrooms and conference rooms, or in performance auditoria and gallery spaces. Post-installation, they should be flexible enough to be reconfigured in order that they do not impact extant acoustic and physical architecture and structure of the installation site. While in use it is desirable that they be capable of real-time changes in acoustic environments in both emergent mixed/virtual/augmented reality and live performance and entertainment situations. To this end, they should also be capable of generating multiple simultaneous acoustic signatures using existing speaker and microphone technology, while also not requiring use of a headset. Finally, unlike current frequency-shifting and notch-based feedback cancellation systems, it is desired to eliminate feedback in a non-destructive manner.

Thus, there is a need for an artificial reverberator/auralization system that suppresses feedback non-destructively. There is also a need for a system that is inexpensive, operating with a minimum of loudspeakers and microphones. There is also a need for a system that is scalable for domestic or institutional deployment, and thus simple to configure and tune.

Due to the many possible deployment scenarios, there is a need for an auralization system that suppresses feedback that doesn't require architectural or structural changes, or specify particular microphones and loudspeaker locations. In addition, there is a need for an auralization system that is capable of using existing loudspeaker arrays, working with readily available speaker technology and capable of performing feedback suppression regardless of microphone polar pattern choice.

SUMMARY

The present embodiments provide a system and method for real-time auralization that uses standard room microphones, loudspeakers, and signal processing tools to synthesize virtual acoustics while canceling feedback. In some embodiments, an estimate of the room sounds is processed to produce a simulated acoustic signal that is played over a loudspeaker. A microphone in the room captures room sounds as well as the simulated acoustics; however, the simulated acoustics component of the microphone signal is estimated and subtracted from the microphone signal, forming an estimate of the room sounds.

According to certain aspects, a system according to embodiments can be integrated into existing speaker arrays, as it requires no proprietary hardware, and can be implemented using inexpensive, readily available software. The system is designed to be easy to set up and straightforward to calibrate. Its ease of use, and mobility afforded by not requiring close mic'ing, creates opportunities for dynamic artistic experiences for performers and audiences in disciplines such as music, theater, dance, and emerging digital art form. Similarly, in gaming, and virtual and augmented reality scenarios the system allows users to dispense with headphones as the sole means for hearing and interacting with virtual acoustic spaces.

Thus, it is an object of the present embodiments to provide an auralization system that is simple to calibrate, and that can be used in a myriad of situations in both domestic and institutional environments; VR/AR/MR gaming and home movie entertainment, theme parks and escape rooms; training simulations, especially those that require group interaction; live musical and theatrical performance events; interactive emergent-media gallery and non-gallery exhibitions; classroom and conference spaces; smart phone/home devices and other telecom conference and streaming systems; listening/hearing aids.

It is another object of the present embodiments to utilize or augment existing speaker arrays at any site and use commonly available microphones of all directional patterns, including omni-directional microphones. Additionally, it is an object of the present invention that it operate successfully with a small number of speakers and microphones. It is also an object of the present invention to be able to make use of any existing loudspeaker or microphones already installed in the venue, and do so without compromising the diffusion capabilities of the system in place.

It is a further object of the present embodiments to suppress feedback while maintaining the original signal quality. It is also an object of the present invention to suppress feedback irrespective of microphone placement, so as to cover any portion of the venue. It is an object of the present invention to be capable of being deployed for gaming, virtual/augmented/mixed reality scenarios, home movie and entertainment, training and simulation situations that require unmediated audio (i.e., audio delivered without the mediate of headphones) and any time varying situations such as those found in music and theatrical rehearsals and performances, artistic sound installations, and hearing aid calibration. It is further an object of the present system that it be capable of creating multiple simultaneous acoustic signatures and is capable of realizing any single or multiple sets of impulse responses, or replacing or adapting such sets in real time.

BRIEF DESCRIPTION OF THE DRAWINGS

These and other aspects and features of the present embodiments will become apparent to those ordinarily skilled in the art upon review of the following description of specific embodiments in conjunction with the accompanying figures, wherein.

DETAILED DESCRIPTION

Figure 1:
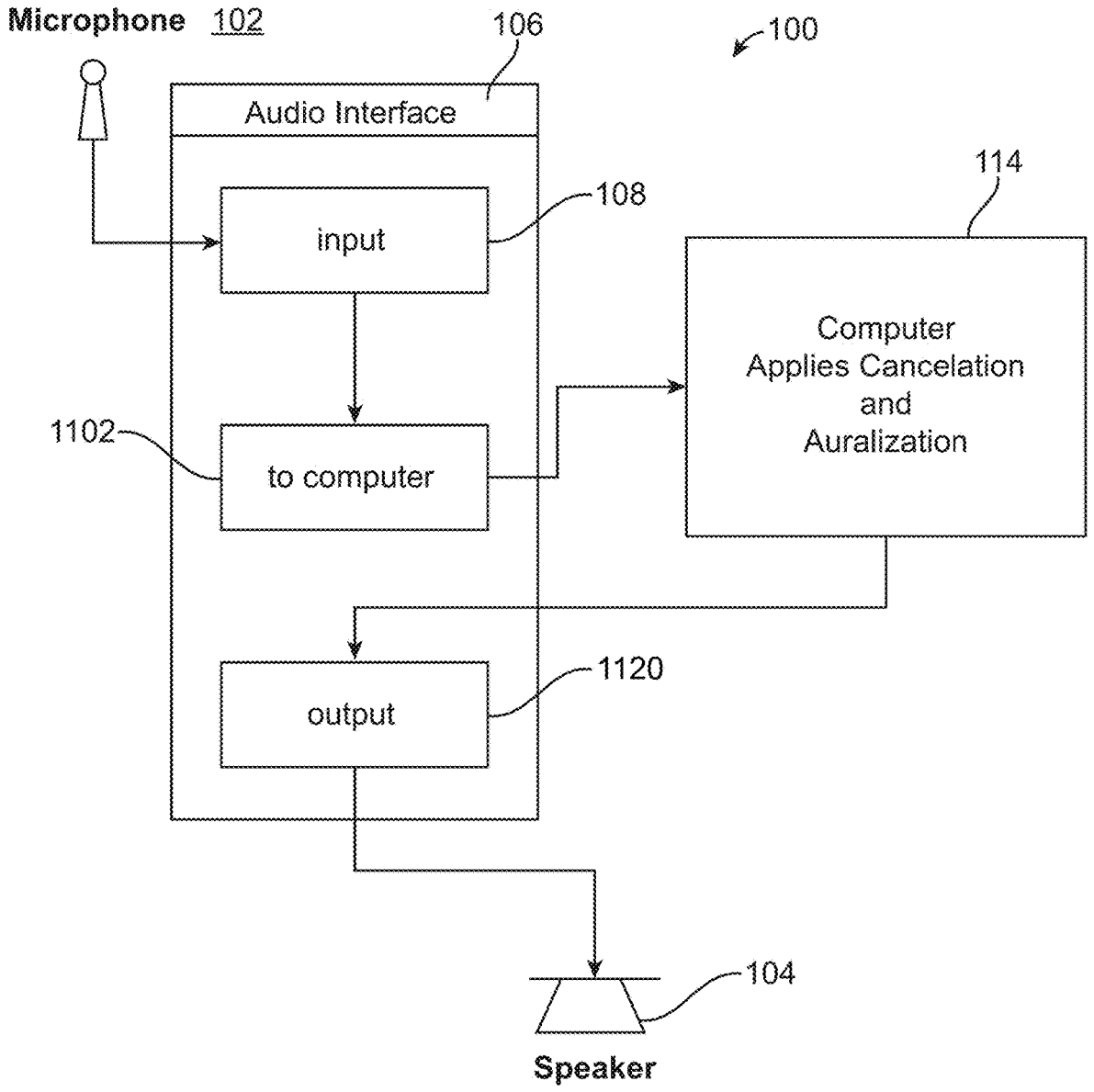
FIG. 1 is a block diagram illustrating an example system according to embodiments.

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

According to certain aspects, the present embodiments provide a system and method for real-time auralization that uses standard room microphones, loudspeakers, and inventive signal processing tools to synthesize virtual acoustics while canceling the feedback. The cancellation method described herein uses an adaptive noise cancellation approach (see, e.g., Widrow, B., et al., "Adaptive Noise Cancelling: Principles and Applications," Proceedings of the IEEE, 63(12), pp. 1692-1716, 1975, hereinafter [32]) in which a primary signal is the sum of a desired signal and unwanted noise. In that approach, a reference signal, which is correlated with the unwanted noise, is used to estimate and subtract the unwanted noise from the primary signal. Related literature also includes echo cancellation and dereverberation (see, e.g., Emanuel Habets, "Fifty years of reverberation reduction: From analog signal processing to machine learning," AES 60th Conference on DREAMS, 2016, hereinafter [12]; Patrick A Naylor and Nikolay D Gaubitch, Eds., Speech Dereverberation, Springer, 2010, hereinafter [13]; and Francis Rumsey, "Reverberation . . . and how to remove it," Journal of the Acoustical Society of America, vol. 64, no. 4, pp. 262-6, April 2016, hereinafter [14]).

In one embodiment, a loudspeaker and microphone are configured in a room having a sound source. Room sounds are reverberated according to the acoustics of a desired target space and presented over loudspeakers, thereby augmenting the acoustics of the room. The room microphone captures sound from the room sound sources as well as from the loudspeaker playing the simulated acoustics. Measurements of the impulse response between the loudspeaker and microphone are used to estimate and subtract the simulated acoustics from the microphone signal, thereby eliminating feedback. In another embodiment, impulse responses between a plurality of loudspeakers and microphones are used to cancel simulated acoustics from multiple loudspeakers for each microphone.

In an additional embodiment, multiple impulse response measurements between a loudspeaker and microphone are made, and estimates of the impulse response standard deviation as a function of time and frequency band are formed, and used in designing the processing to cancel the synthesized acoustics from the microphone signals. In a further embodiment, the correlation between a loudspeaker and microphone signal is used to adaptively modify the cancellation processing.

FIG. 1 is a block diagram illustrating an example system according to embodiments.

As shown, example system 100 includes a microphone 102 and speaker 104 that are both connected to an audio interface 106. Audio interface 106 includes an input 108 connected to microphone 102 and an output 110 connected to speaker 104. Audio interface 106 further includes a port 112 connected to computer 114 (e.g. desktop or notebook computer, pad or tablet computer, smart phone, etc.). It should be noted that other embodiments of system 100 can include additional or fewer components than shown in the example of FIG. 1. For example, although FIG. 1 illustrates an example with one microphone 102 and one speaker 104, it should be apparent that there can by two or more microphones 102 and/or two or more speakers 104.

Moreover, although shown separately for ease of illustration, it should be noted that certain components of system 100 can be implemented together. For example, computer 114 can comprise digital audio workstation software (e.g. implementing auralization and cancelation processing according to embodiments) and be configured with an audio interface such as 106 connected to microphone preamps (e.g. input 108) and microphones (e.g. microphone 102) and a set of powered loudspeakers (e.g. speaker 104). In these and other embodiments, certain components can also be integrated into existing speaker arrays, and can be implemented using inexpensive and readily available software. For example, in virtual, augmented, and mixed reality scenarios, the system allows users to dispense with headphones for more immersive virtual acoustic experiences. Other hardware and software, including special-purpose hardware and custom software, may also be designed and used in accordance with the principles of the present embodiments.

In general operation according to aspects of embodiments, room sounds (e.g. a music performance, voices from a virtual reality game participant, etc.) are captured by microphone 102. The captured sounds (i.e. microphone signals) are provided via interface 106 to computer 114, which processes the signals in real time to perform artificial reverberation according to the acoustics of a desired target space (i.e. auralization). The processed sound signals are then presented via interface 106 over speaker 104, thereby augmenting the acoustics of the room and enriching the experience of performers, game players, etc. As should be apparent, the room microphone 102 will also capture sound from the speaker 104, which is playing the simulated acoustics. According to aspects of the present embodiments, and as will be described in more detail below, computer 114 further estimates and subtracts the simulated acoustics in real time from the microphone signal, thereby eliminating feedback.

Figure 2:
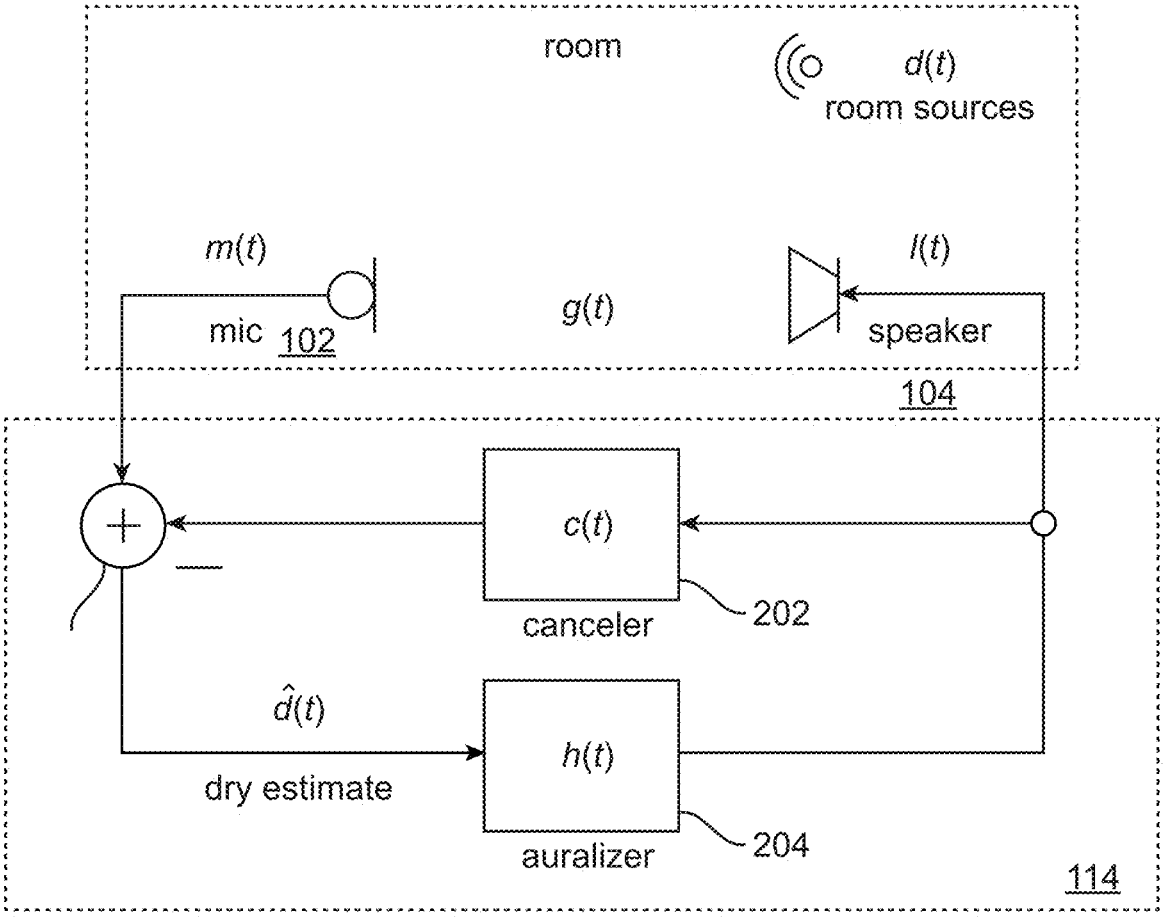
FIG. 2 is a signal flow diagram illustrating an example feedback canceling auralization system according to embodiments.

FIG. 2 is a signal flow diagram illustrating processing performed by system 100 (e.g. computer 114) according to an example embodiment. As shown in FIG. 2, example computer 114 in embodiments includes a canceler 202 and an auralizer 204. In operation of system 100, a room microphone 102 captures contributions from room sound sources d(t) and synthetic acoustics produced by the loudspeaker 104 according to its applied signal 1(*t*), t denoting time. Auralizer 204 imparts the sonic characteristic of a target space, embodied by the impulse response h(t), on the room sounds d(t) through convolution, $$l(t)=h(t)*d(t). \tag{1}$$

Many known auralization techniques can be used to implement auralizer 204, such as those using fast, low-latency convolution methods to save computation (e.g., William G. Gardner, "Efficient convolution without latency," Journal of the Audio Engineering Society, vol. 43, pp. 2, 1993, hereinafter [16]; Guillermo Garcia, "Optimal filter partition for efficient convolution with short in-put/output delay," in Proceedings of the 113th Audio Engineering Society Convention, 2002, hereinafter [17]; and Frank Wefers and Michael Vorländer, "Optimal filter partitions for real-time fir filtering using uniformly-partitioned fft-based convolution in the frequency-domain," in Proceedings of the 14th International Conference on Digital Audio Effects, 2011, pp. 155-61, hereinafter [18]). Another "modal reverberator" approach is disclosed in U.S. Pat. No. 9,805,704, the contents of which are incorporated herein by reference in their entirety. Although these known techniques can provide a form of impulse response h(t) used by auralizer 204, the difficulty is that the room source signals d(t) are not directly available: As described above, the room microphones also pick up the synthesized acoustics, and would cause feedback if the room microphone signal m(t) were reverberated without additional processing.

According to certain aspects, the present embodiments auralize (e.g. using known techniques such as those mentioned above) an estimate of the room source signals d^(t), formed by subtracting from the microphone signal m(t) an estimate of the synthesized acoustics (e.g. the output of speaker 104). Assuming the geometry between the loudspeaker and microphone is unchanging, the actual "dry" signal d(t) is determined by:

$$d(t)=m(t)-g(t)*l(t), \tag{2}$$

where g(t) is the impulse response between the loudspeaker and microphone. Embodiments design an impulse response c(t), which approximates the loudspeaker-microphone response, and use it to form an estimate of the "dry" signal, d^(t), which is determined by:

$$\hat{d}(t)=m(t)-c(t)*l(t). \tag{3}$$

as shown in the signal flow diagram FIG. 2. The synthetic acoustics are canceled from the microphone signal m(t) by canceler 202 and subtractor 206 to estimate the room signal d^(t), which signal is reverberated by auralizer 204.

The question then becomes how to obtain the canceling filter c(t). A measurement of the impulse response g(t) provides an excellent starting point, though there are time-frequency regions over which the response is not well known due to measurement noise (typically affecting the low frequencies), or changes over time due to air circulation or performers, participants, or audience members moving about the space (typically affecting the latter part of the impulse response). In regions where the impulse response is not well known, it is preferred that the cancellation be reduced so as to not introduce additional reverberation.

Here, the cancellation filter 202 impulse response c(t) is preferably chosen to minimize the expected energy in the difference between the actual and estimated room microphone loud-speaker signals. For simplicity of presentation and without loss of generality, assume for the moment that the loudspeaker-microphone impulse response is a unit pulse, i.e.

$$g(t)=g\delta(t), \tag{4}$$

and that the impulse response measurement $\tilde{g}(t)$ is equal to the sum of the actual impulse response and zero-mean noise with variance $\sigma g^2$. Consider a canceling filter c(t) which is a windowed version of the measured impulse response $\tilde{g}(t)$, $$c(t)=w\tilde{g}\delta(t), \tag{5}$$

In this case, the measured impulse response is scaled according to a one-sample-long window w. The expected energy in the difference between the auralization and cancellation signals at time t is $$E[(gl(t)-w\tilde{g}l(t))^2]=l^2(t)[w^2\sigma g^2+g^2(1-w)^2]. \tag{6}$$

Minimizing the residual energy over choices of the window w yields $$c^*(t)=w^*\tilde{g}\delta(t),\ w^*=g^2/(g^2+\sigma g^2)$$

In other words, the optimum canceler response c*(t) is a Wiener-like weighting of the measured impulse response, $w^*\tilde{g}\delta(t)$. When the loudspeaker-microphone impulse response magnitude is large compared with the impulse response measurement uncertainty, the window w will be near 1, and the cancellation filter will approximate the measured impulse response. By contrast, when the impulse response is poorly known, the window w will be small—roughly the measured impulse response signal-to-noise ratio—and the cancellation filter will be attenuated compared to the measured impulse response. In this way, the optimal cancellation filter impulse response is seen to be the measured loudspeaker-microphone impulse response, scaled by a compressed signal-to-noise ratio (CSNR).

Typically, the loudspeaker-microphone impulse response g(t) will last hundreds of milliseconds, and the window will preferably be a function of time t and frequency f that scales the measured impulse response. Denote by $\tilde{g}(t, fb)$, b=1, 2, . . . N the measured impulse response $\tilde{g}(t)$ split into a set of N frequency bands fb, for example using a filterbank, such that the sum of the band responses is the original measurement, $$\tilde{g}(t)=\mathrm{Sum}(\tilde{g}(t,fb)),\ b=1 \text{ to } N. \tag{8}$$

In this case, the canceler response c*(t) is the sum of measured impulse response bands $\tilde{g}(t, fb)$, scaled in each band by a corresponding window w*(t, fb). Expressed mathematically, $$c^*(t)=\mathrm{Sum}(c^*(t,fb)),\ b=1 \text{ to } N, \tag{9}$$

where $$c^*(t,fb)=w^*(t,fb)\tilde{g}(t,fb), \tag{10}$$

$$w^*(t,fb)=g^2(t,fb)/(g^2(t,fb)+\sigma g^2(t,fb)) \tag{11}$$

Embodiments use the measured impulse $\tilde{g}(t, fb)$ as a stand-in for the actual impulse g(t, fb) in computing the window w(t, fb). Alternatively, repeated measurements of the impulse response g(t, fb) could be made, with the measurement mean used for g(t, fb), and the variation in the impulse response measurements as a function of time and frequency used to form $\sigma g^2(t, fb)$. Embodiments also perform smoothing of $g^2(t, fb)$ over time and frequency in computing w(t, fb) so that the window is a smoothly changing function of time and frequency.

Figure 3:
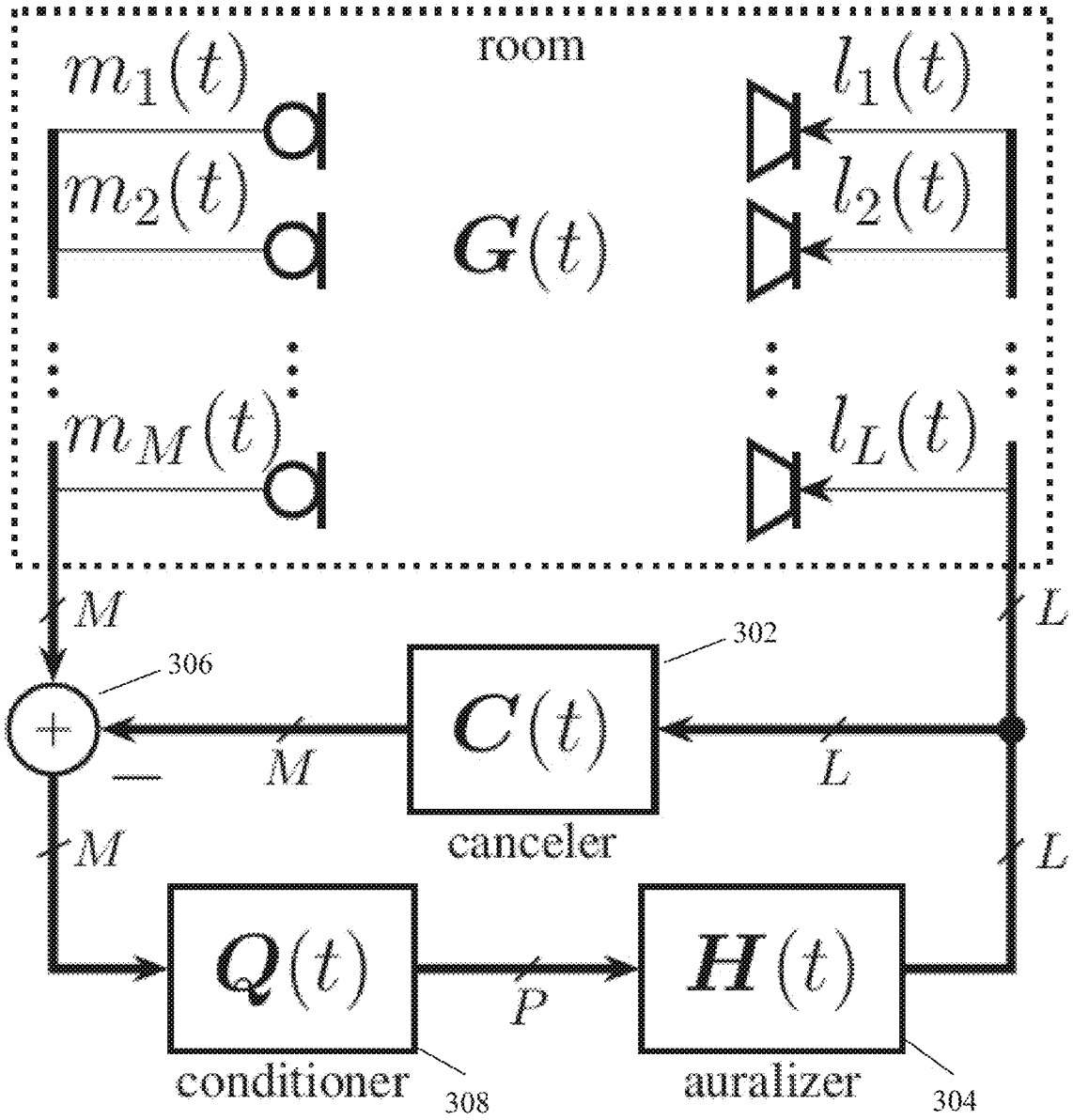
FIG. 3 is a signal flow diagram illustrating another example feedback canceling auralization system according to embodiments.

It should be noted that the principles described above can be extended to cases other than a single microphone-loudspeaker pair, as shown in FIG. 3. Referring to FIG. 3, in the presence of L loudspeakers and M microphones, a matrix of loudspeaker-microphone impulse responses is measured, and used in subtracting auralization signal estimates from the microphone signals. Stacking the microphone signals into an M-tall column m(t), and the loudspeaker signals into an L-tall column l(t), the cancellation system becomes $$l(t)=H(t)*m(t), \tag{12}$$

$$\hat{d}(t)=m(t)-C(t)*l(t), \tag{13}$$

where H(t) is the matrix of auralizer filters of 304 and C(t) the matrix of canceling filters of 302. As in the single speaker-single microphone case, the canceling filter matrix is the matrix of measured impulse responses, each windowed according to its respective CSNR, which may be a function of both time and frequency.

Moreover, a conditioning processor 308, denoted by Q, can be inserted between the microphones and auralizers, $$l(t)=H(t)*Q(m(t)), \tag{14}$$

$$\hat{d}(t)=Q(m(t))-C(t)*l(t), \tag{15}$$

as seen in FIG. 3. This processor 308 could serve a number of functions. In one example Q could act as the weights of a mixing matrix to determine how the microphones signals are mapped to the auralizers, and subsequently, the loudspeakers. For example, it might be beneficial for microphones that are on one side send the majority of their energy to loudspeakers on the same side of the room, as could be achieved using a B-format microphone array and Ambisonics processing driving the loudspeaker array. Another use could be for when the speaker array and auralizers are used to create different acoustics in different parts of the room. The processor Q could also be a beamformer or other microphone array processor to auralize different sounds differently according to their source position. Additionally, this mechanism allows the acoustic to be changed from one virtual space to another in realtime, both instantaneously or gradually.

Figure 4:
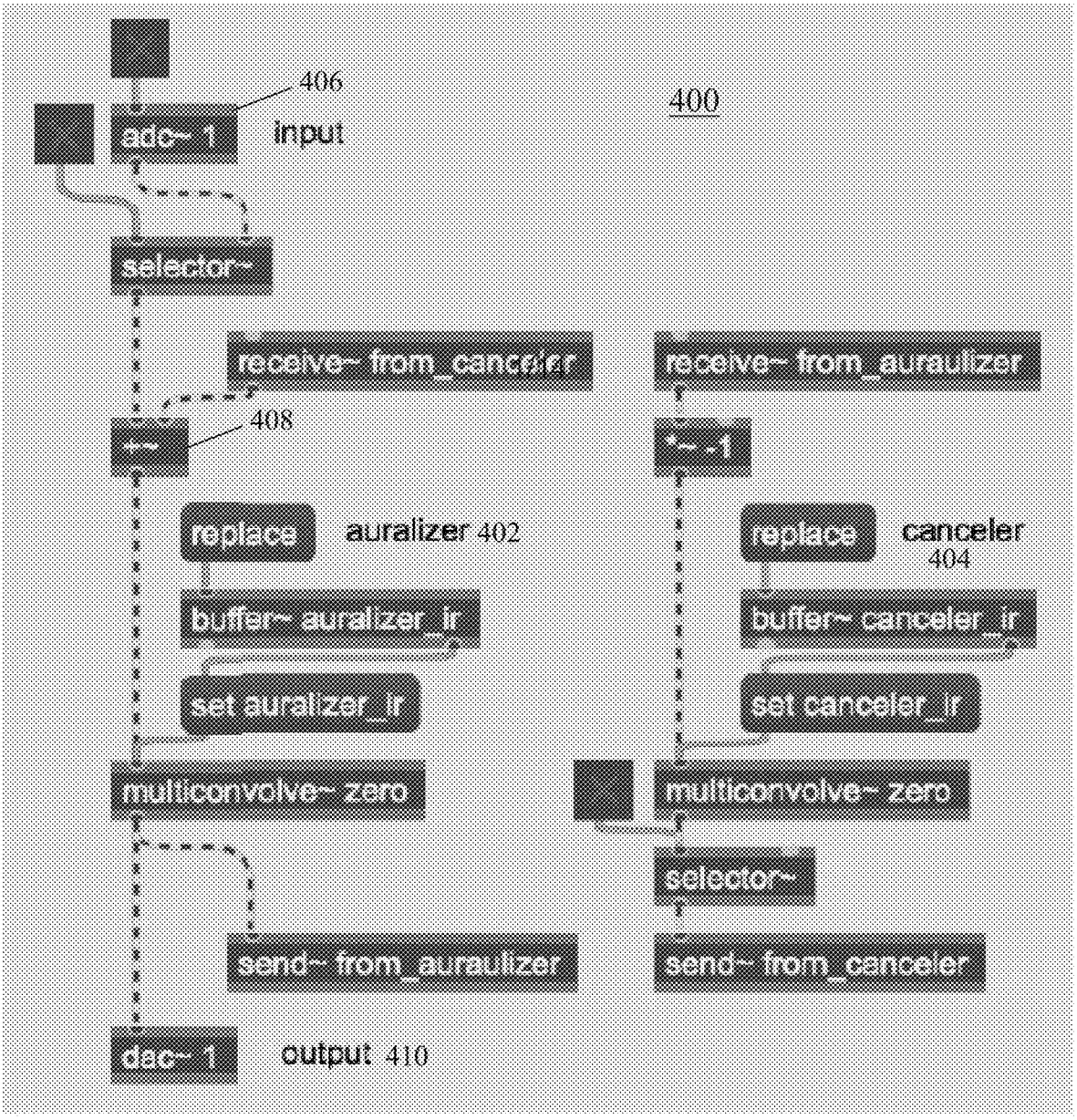
FIG. 4 is a diagram of a Max/MSP patch showing one possible implementation of a canceling reverberator according to embodiments.

The signal flows of FIGS. 2 and 3 are straightforward to implement in any number of environments. A Max/MSP implementation of a single-microphone, single-loudspeaker canceling auralizer is shown in FIG. 4, in this example making use of Alexander Harker and Pierre Alexandre Tremblay, "The HISSTools impulse response toolbox: Convolution for the masses," in Proceedings of International Computer Music Conference, 2012 (hereinafter [19]) for low-latency fast convolution.

As shown in FIG. 4, the example implementation 400 includes auralizer chain 402 and canceler chain 404. The input microphone signal m(t) is digitized at 406 and provided to subtractor 408, which subtracts from it the output from canceler chain 404 including the cancelation filter c(t). The difference signal (e.g. the signal $\hat{d}(t)$) is then processed by auralizer chain 402 (including impulse response h(t)), whose output (e.g. the signal l(t)) is also provided to canceler chain 404. The final output (e.g. the signal l(t)) is then converted back to analog at output 410 and provided to the speaker.

According to certain aspects, a system such as described above in connection with FIGS. 1 to 4 can be reconfigured and recalibrated for use in many different environments. For example, the system can be relocated from venue to venue or room to room, and/or the positions and numbers of the microphones and speakers can be changed. After making such changes, a straightforward system calibration process to be described in more detail below can be performed, and the system can then be used to perform auralization and feedback cancelation according to the embodiments in the changed configuration. This contrasts with conventional systems, which require very time-consuming and careful tuning processes.

Figure 5:
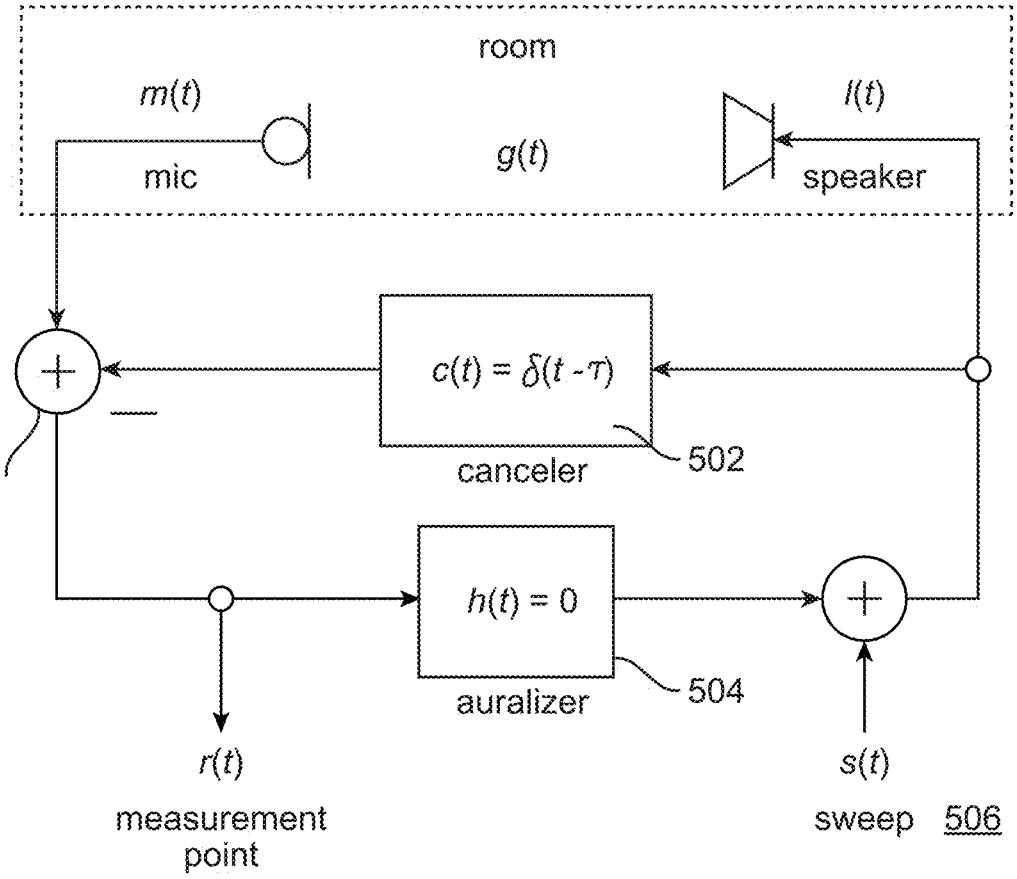
FIG. 5 is a signal flow diagram illustrating aspects of calibrating a feedback canceling auralization system according to embodiments.

FIG. 5 is an example signal flow diagram illustrating a calibration process according to embodiments in a single microphone-speaker pair system such as that shown in FIGS. 1 and 2. Those skilled in the art will understand how to implement the process using any numbers of pairs of microphones and speakers after being taught by these examples. As shown in FIG. 5, to calibrate the system after being placed in an environment such as a room and a microphone-speaker pair, the canceler 502 impulse response c(t) may be set to a delayed pulse, and the auralizer 504 filter is turned off. In place of the output of auralizer 504, a sine sweep 506 s(t) is played through the speaker and the impulse response g(t) after subtractor 508 is measured at measurement point 510. Multiple measurements are obtained and used to derive the impulse response g(t, fb) and window w*(t, fb) and thus the canceler filter c*(t, fb) as described above and explained further below.

Figure 6:
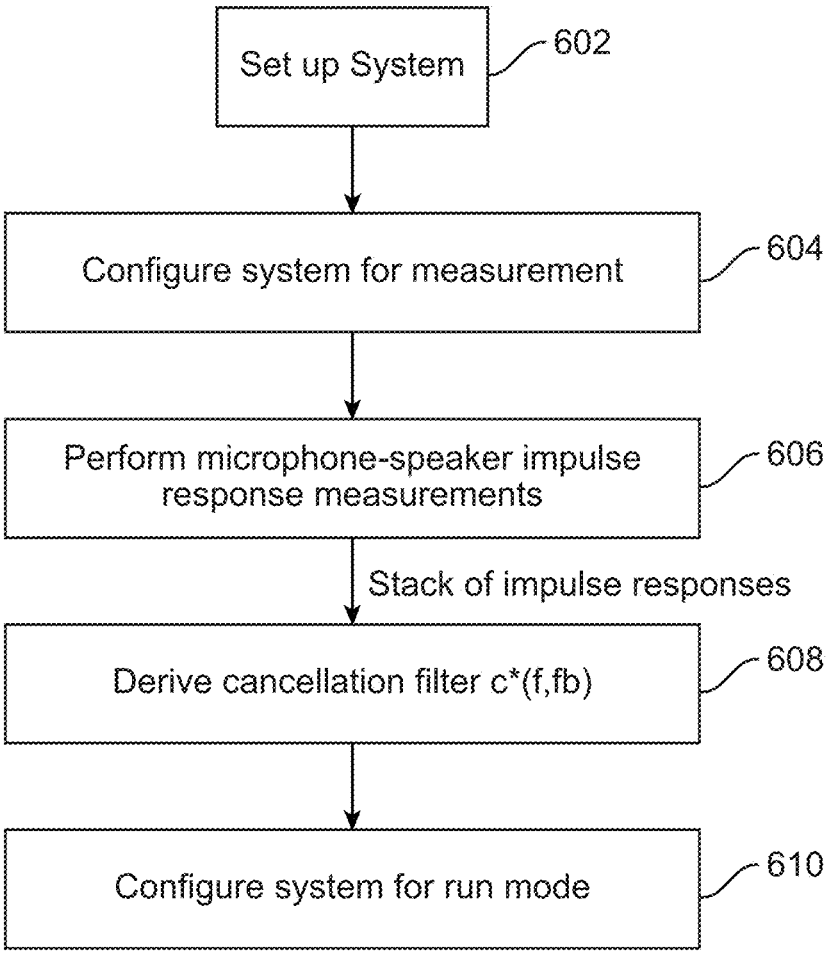
FIG. 6 is a flowchart illustrating an example methodology for calibrating a feedback canceling auralization system according to embodiments.

FIG. 6 is a flowchart illustrating an example calibration methodology according to embodiments.

As shown in FIG. 6, in 602 the system is set up in the desired venue/room/environment. This includes positioning the microphone(s) and speaker(s) in their desired locations. Thereafter, in 604, the system is configured to perform measurements, for example configuring the system according to the signal flow shown in FIG. 5 (e.g. setting the canceler 502 impulse response to a delayed pulse, turning off the auralizer 504 filter, and injecting a sine sweep to the speaker input).

In 606, a single or multiple microphone-speaker pair impulse response measurement(s) are made using a sine sweep or other test signal, preferably covering the entire audio band, fed to the speaker(s). In embodiments, this can include dozens of measurements of the empty space or the space with audience member stand-ins to understand the variation over time of the impulse responses between each pair of the microphones and speakers.

Figure 7:
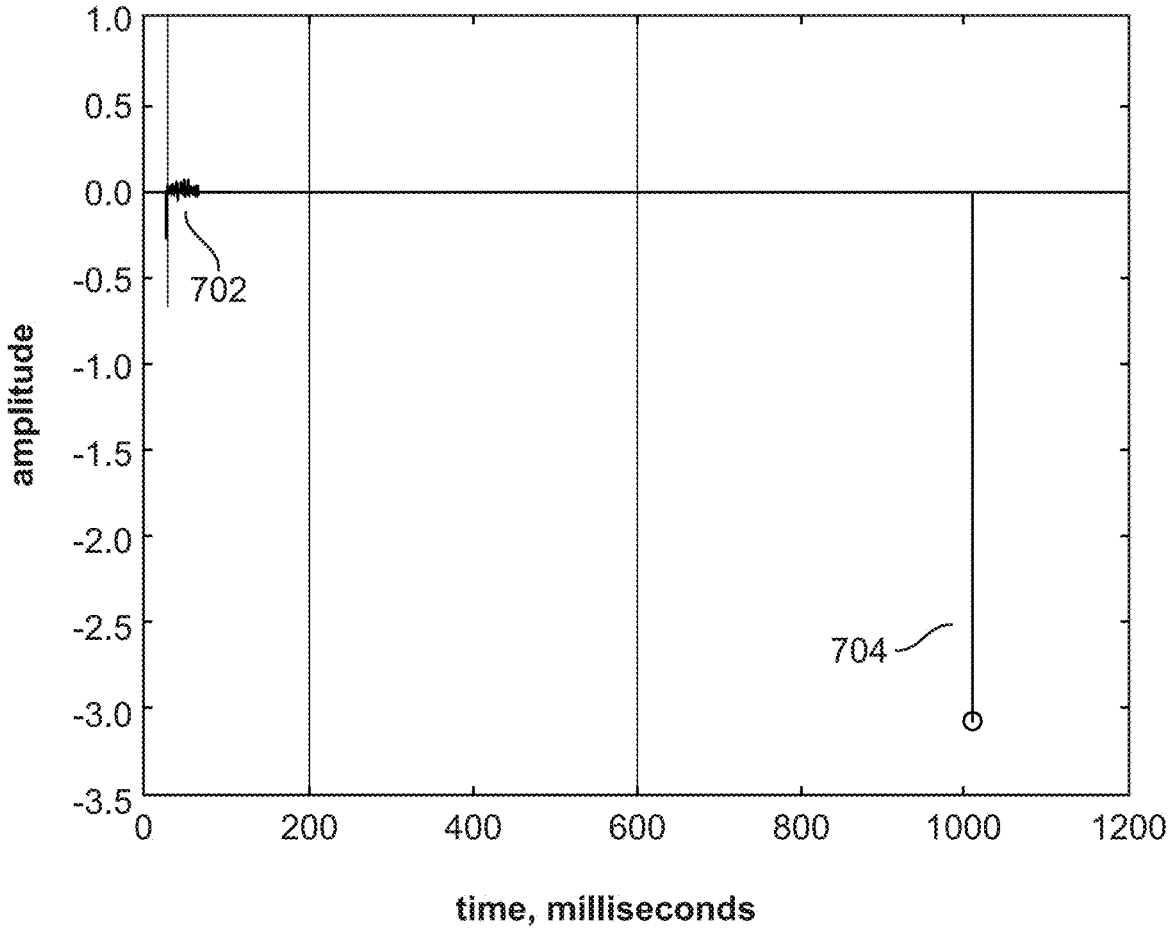
FIG. 7 is a diagram illustrating aspects of an example impulse measurement obtained in connection with the methodology of FIG. 6.

In 608, the impulse response measurements are used to derive the cancellation filter as a function of time t and frequency fb. For example, an average of the measured impulse responses can be used to derive $\bar{g}(t, fb)$, and the standard deviation of the measured impulse responses can be used to derive $\sigma g^2(t, fb)$. The optimal window w*(t, fb) may then be derived according to (11) described above. Finally, to find the cancellation filter c(t, fb), the measured impulse response $\bar{g}(t, fb)$ is shifted and scaled according to the amplitude and arrival time of the $c(t)=\delta(t-\tau)$ pulse in the measurement system. For example, FIG. 7 shows an example impulse response measurement (e.g. the signal r(t) in FIG. 5). More particularly, as shown in FIG. 7, the cancellation processor (e.g. output of subtractor 508) reproduces the impulse response 702 between the loudspeaker and microphone. The delayed pulse $\delta(t-\tau)$ of the canceler 502 convolution is also visible.

Figures 8A, 8B:
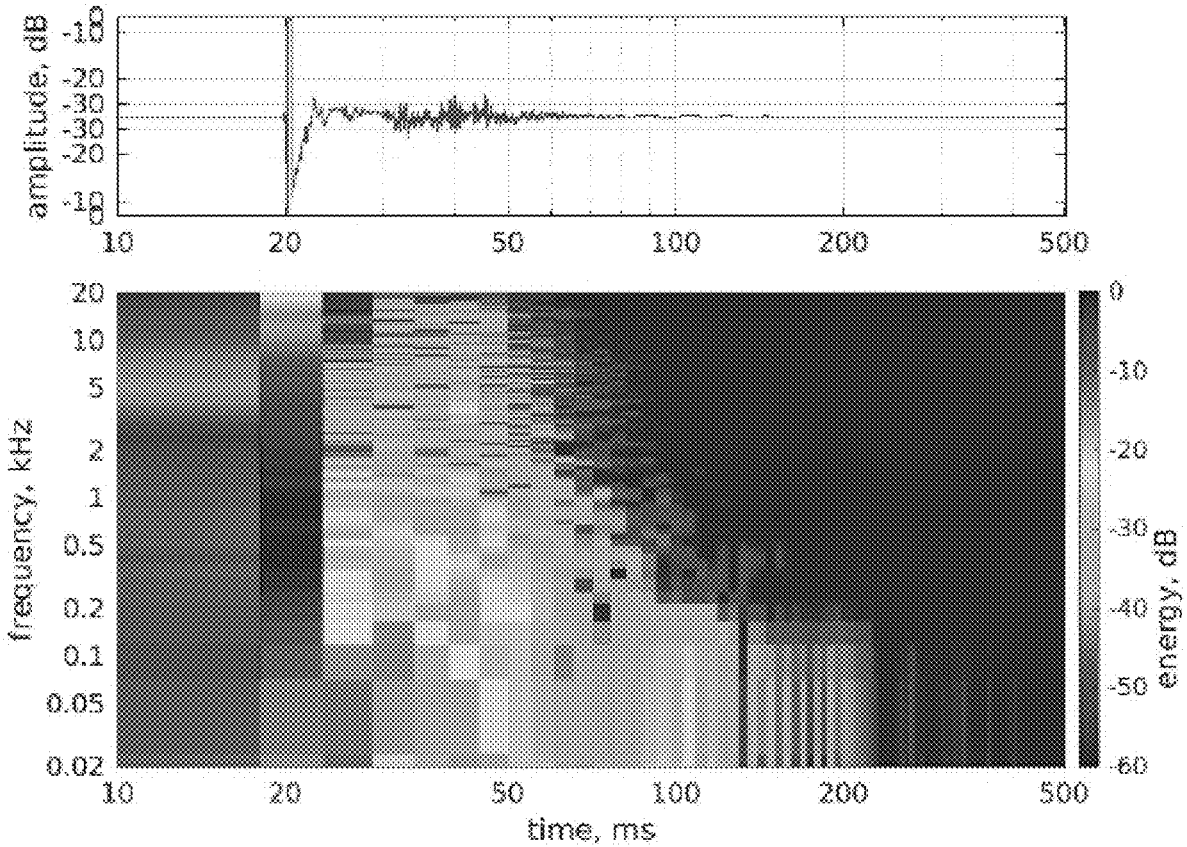
FIGS. 8A and 8B are diagrams illustrating an example cancellation impulse response obtained in accordance with the present embodiments.

An example cancellation impulse response c(t) obtained using the methodology described above is shown in FIG. 8A, and the associated spectrogram is shown in FIG. 8B.

After obtaining the cancellation filter as described above, the system is configured for run mode in 610, for example in accordance with the signal flows of FIGS. 2 and 3.

It is useful to anticipate the effectiveness of the virtual acoustics cancellation in any given microphone. Substituting the optimal windowing (7) into the expression for the canceler residual energy (6), the virtual acoustics energy in the cancelled microphone signal is expected to be scaled by a factor of $$\nu=\sigma g^2/(g^2+\sigma g^2), \tag{16}$$

compared to that in the original microphone signal. Note that the reverberation-to-signal energy ratio is improved in proportion to the measurement variance for accurately measured signals, i.e. $\sigma g^2 \ll g^2$. By contrast, when the impulse response is inaccurately measured, the reverberation-to-signal energy ratio is nearly unchanged, $\nu \approx 1$.

As an example of the performance of the present embodiments, several versions of the system of FIG. 1 with one or two microphones and one or two loudspeakers were implemented in the CCRMA Listening Room and CCRMA Stage recital hall at Stanford University. The example was implemented using a single loudspeaker source, playing exponentially swept sinusoid test signals, and Suzanne Vega's "Tom's Diner" as dry program material.

Figure 9A:
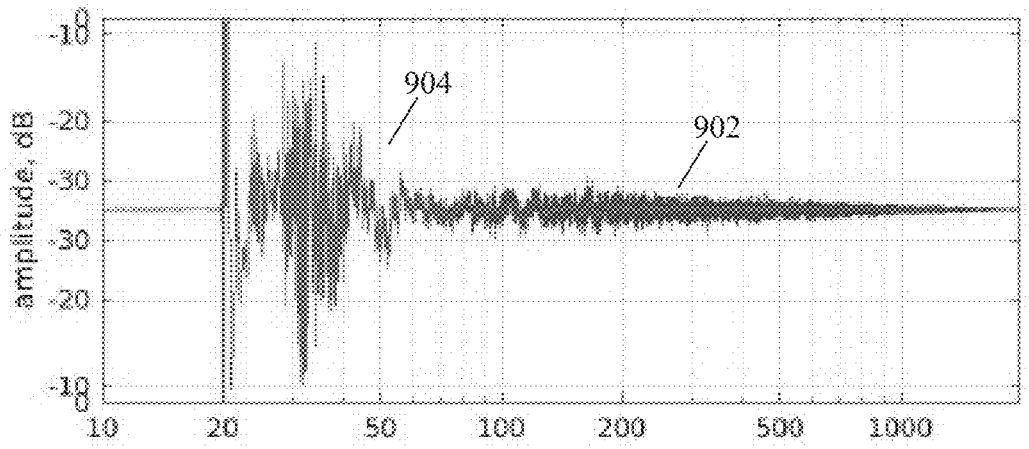
FIGS. 9A to 9C are diagrams illustrating aspects of an example canceling auralizer room impulse response according to embodiments.
Figure 9B:
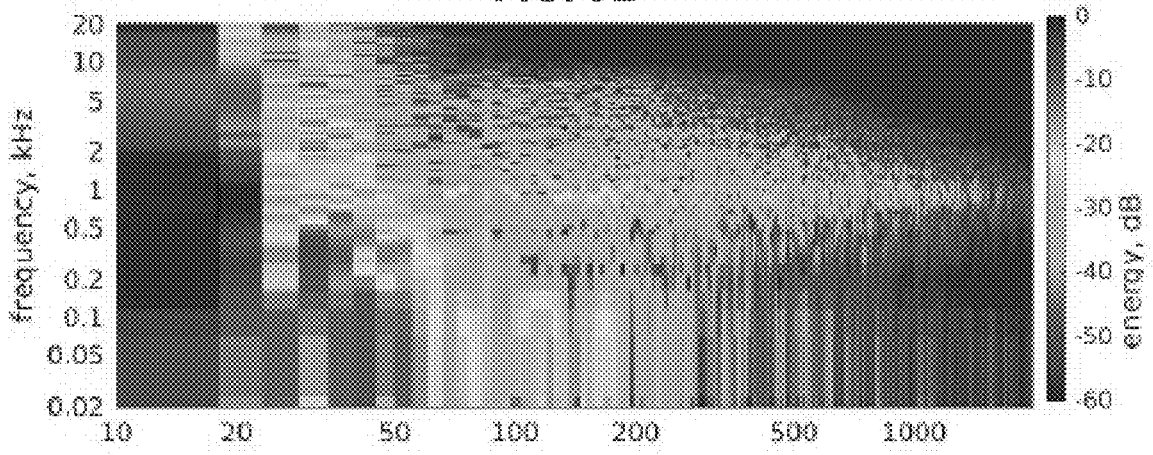
Figure 9C:
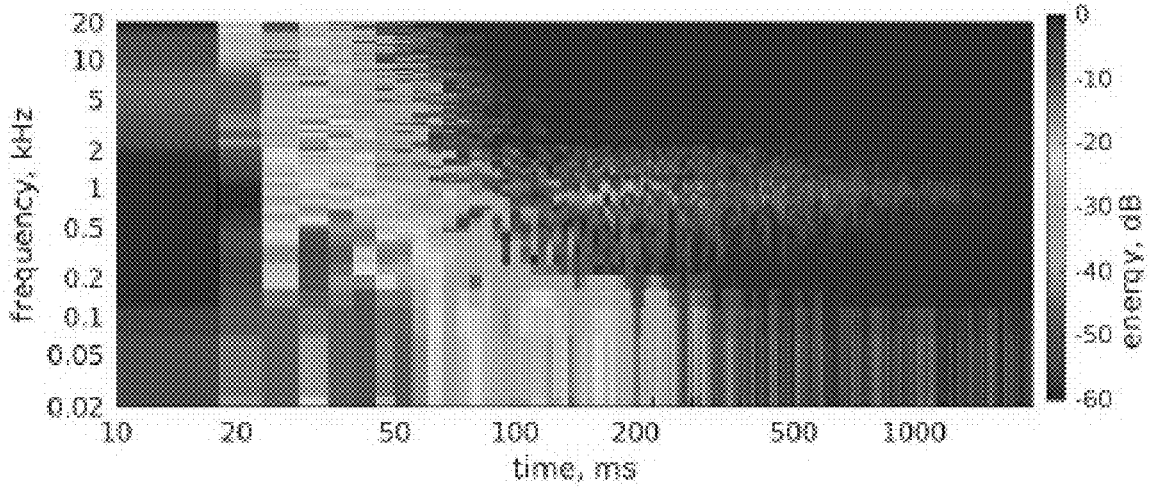

In a first test shown in FIGS. 9A to 9C, the impulse response of the room with the system active was measured. A sine sweep from a separate loudspeaker in the room was used to measure the impulse response between a room source and the canceling reverberator system microphone input (FIG. 9A, 902), and system room source estimate (FIG. 9A, 904). The corresponding spectrograms are also shown. More particularly, as seen in FIG. 9B, the room impulse response contains both the "dry" room response and the "wet" synthesized room acoustics of Memorial Church at Stanford University. The 4.5 s reverberation time is plainly visible. Also shown in FIG. 9C is the system dry signal estimate, $\hat{d}(t)$. Compared to the virtual room impulse response, the canceler produces a substantially dry signal, canceling in excess of 30 dB of the simulated reverberation.

Figure 10A:
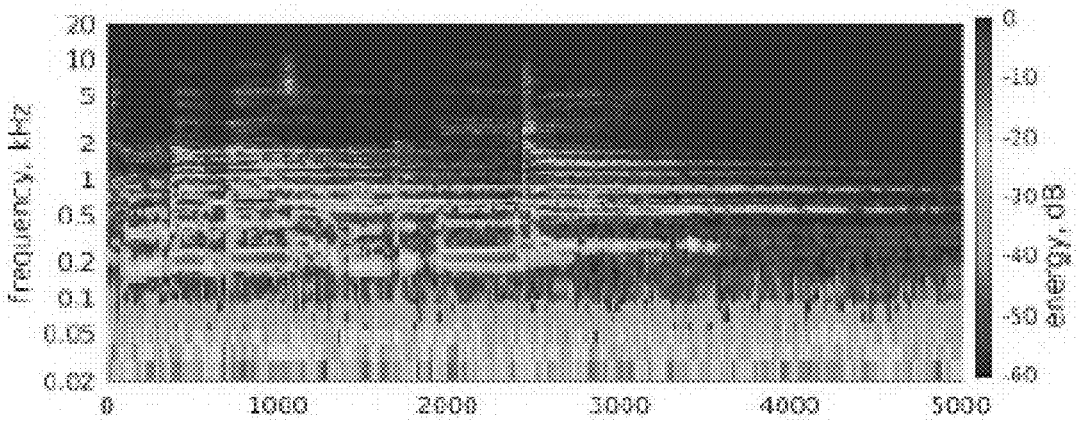
FIGS. 10A to 10C are spectrograms illustrating aspects of another example canceling auralizer room impulse response according to embodiments.
Figure 10B:
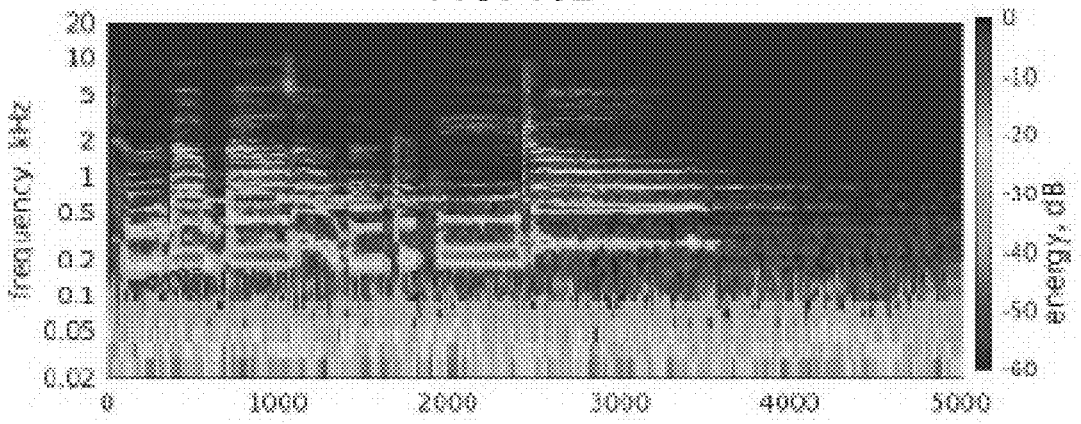
Figure 10C:
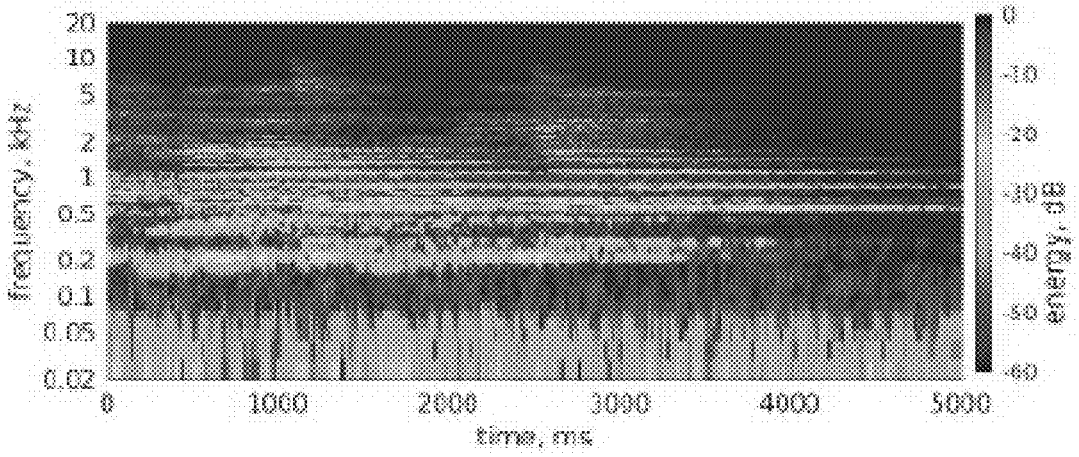

FIGS. 10A to 10C illustrate another example response of the system to a dry source, Suzanne Vega's "Tom's Diner." Spectrograms are shown for the microphone signal in FIG. 10A, the room signal estimate in FIG. 10B, and the synthetic acoustics projected into the room in FIG. 10C. Note that the room signal estimate contains little of the synthetic reverberation, and is effectively a mix of the dry Suzanne Vega track, and low-frequency ventilation noise also present in the room. As expected, the room response in FIG. 10C shows the imprint of the Memorial Church acoustics, as added by the system.

Figures 11A, 11B:
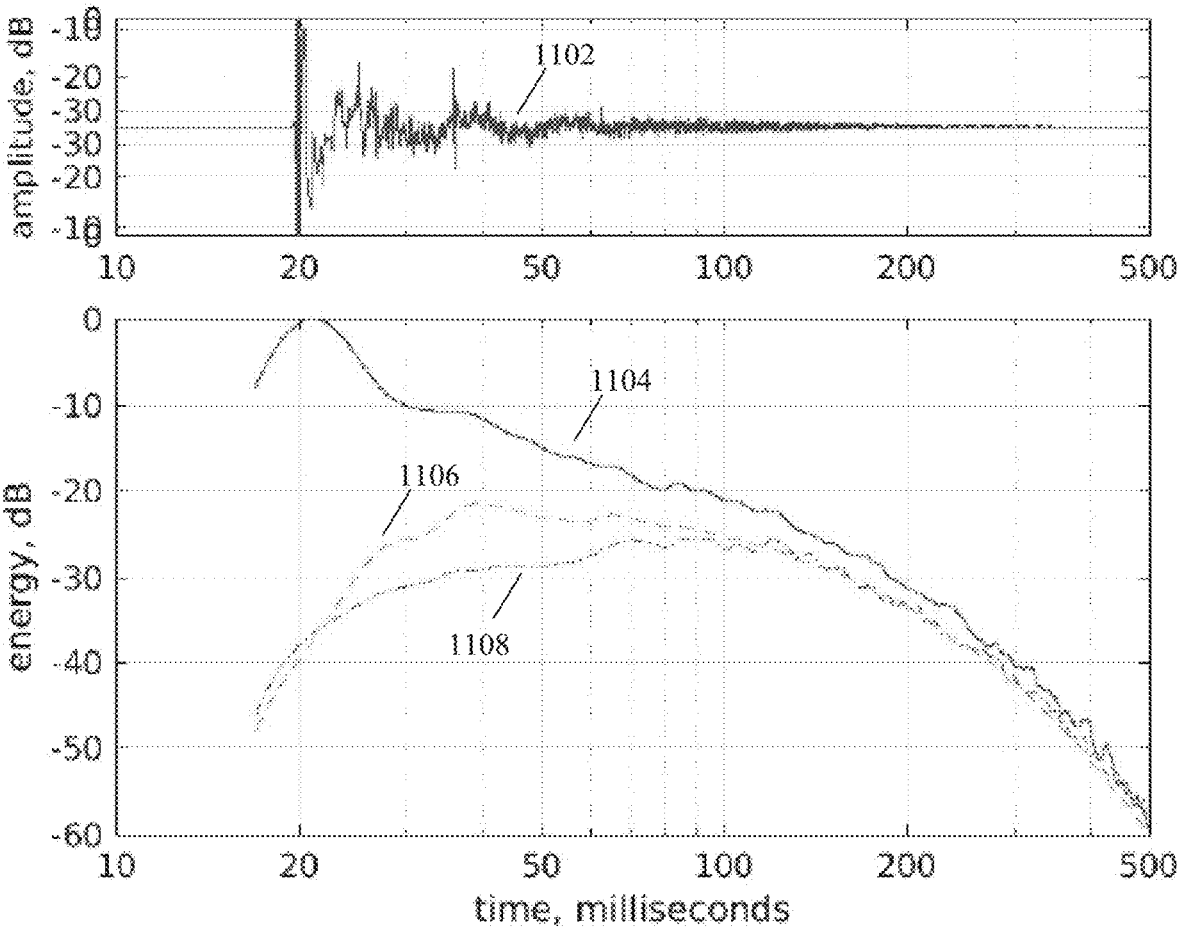
FIGS. 11A and 11B are diagrams illustrating aspects of impulse response variation according to embodiments.

To better understand the practical performance of the system, the present applicants made repeated measurements of the loudspeaker-microphone response at the CCRMA Stage in unoccupied and occupied conditions. FIG. 11A shows the mean room impulse response 1102, and FIG. 11B shows the impulse response energy, smoothed over a 10-millisecond-long Hanning window by curve 1104. The sample standard deviation is shown separately by curve 1106 for the unoccupied condition and by curve 1108 for the occupied condition. As can be seen, the impulse response variation is smallest relative to the impulse response energy near the beginning of the impulse response. Also, the variation for the occupied room is modestly larger as the room becomes mixed. As further seen in FIG. 11B, the canceler residual energy is small near the beginning of the response, and increases relative to the decreasing impulse response energy throughout the response, consistent with the notion that the beginning of the impulse response shows little variation.

Figure 12:
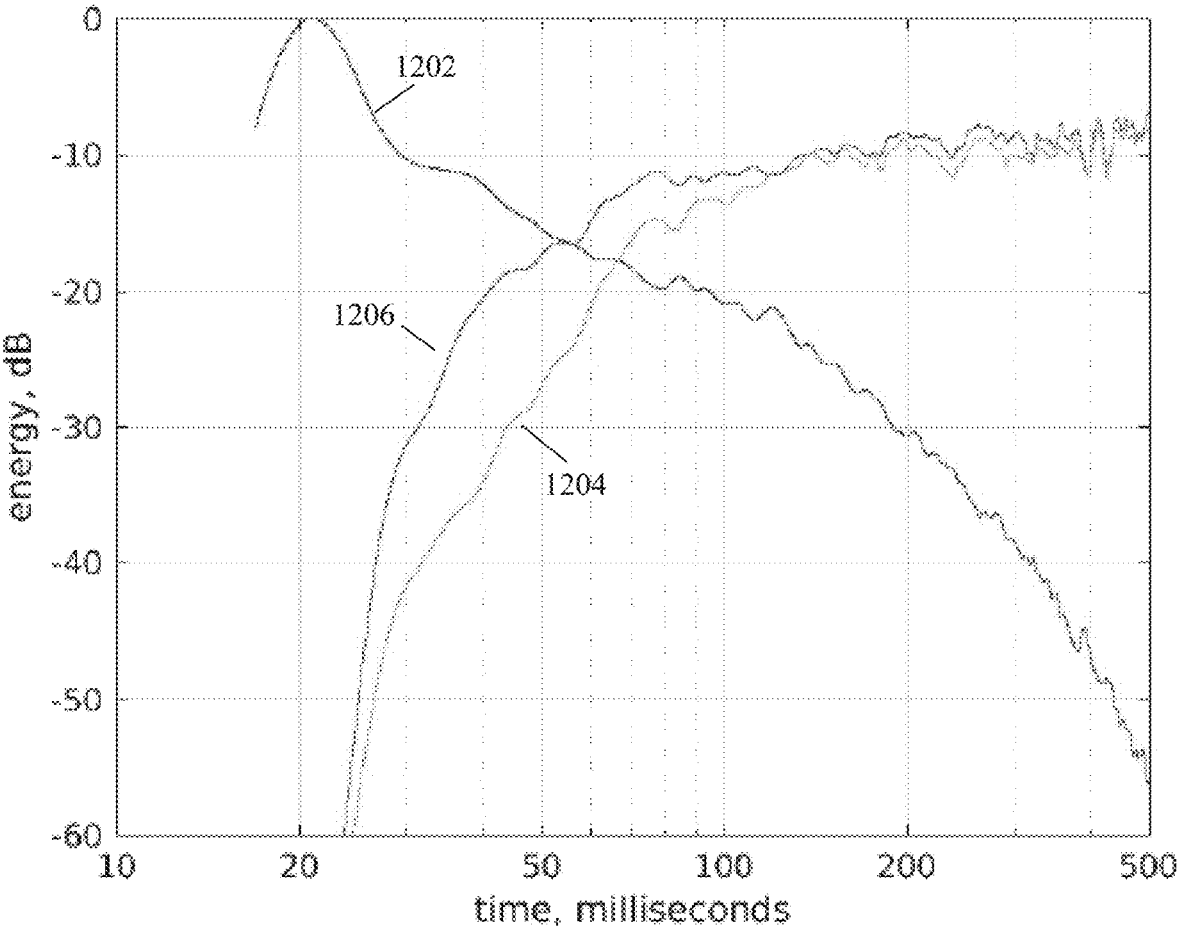
FIG. 12 is a diagram illustrating further aspects of impulse response variation according to embodiments.

FIG. 12 shows results of the measurements described in connection with FIGS. 11A and 11B in alternate detail. Similar to curve 1104 in FIG. 11B, the smoothed energy of the mean loudspeaker-microphone impulse response is shown by curve 1202, together with the residual energy of suppressed loudspeaker signals for the unoccupied (curve 1204) and occupied (curve 1206) conditions. Note that the cancellation is most effective at the impulse response start, during which there is little variation.

Figure 13A:
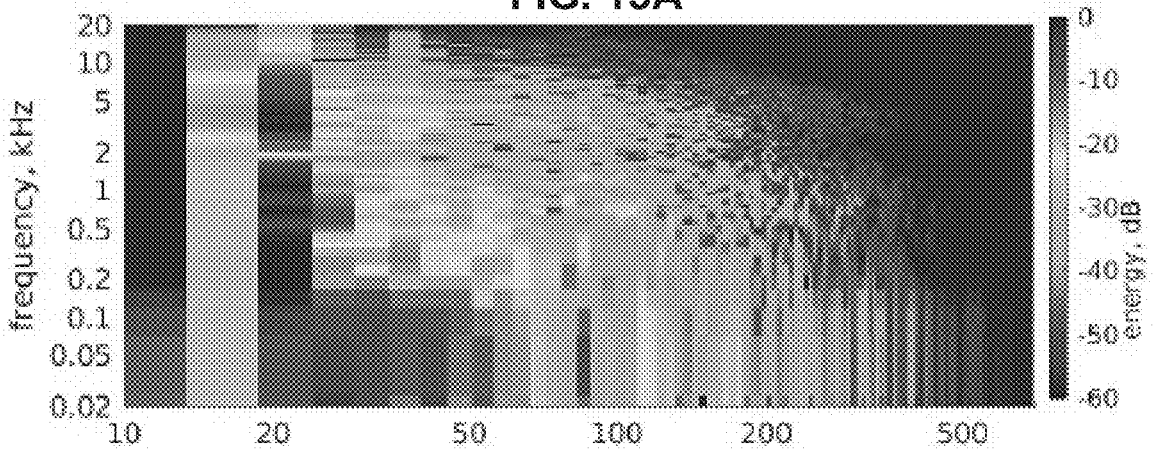
FIGS. 13A to 13C are spectrograms illustrating an example of canceler performance and residual energy in accordance with embodiments.
Figure 13B:
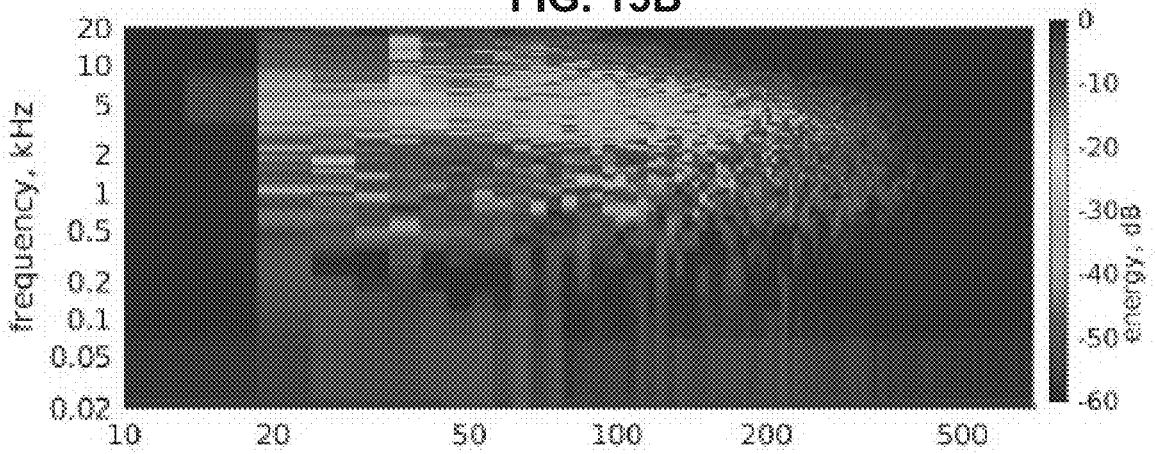
Figure 13C:
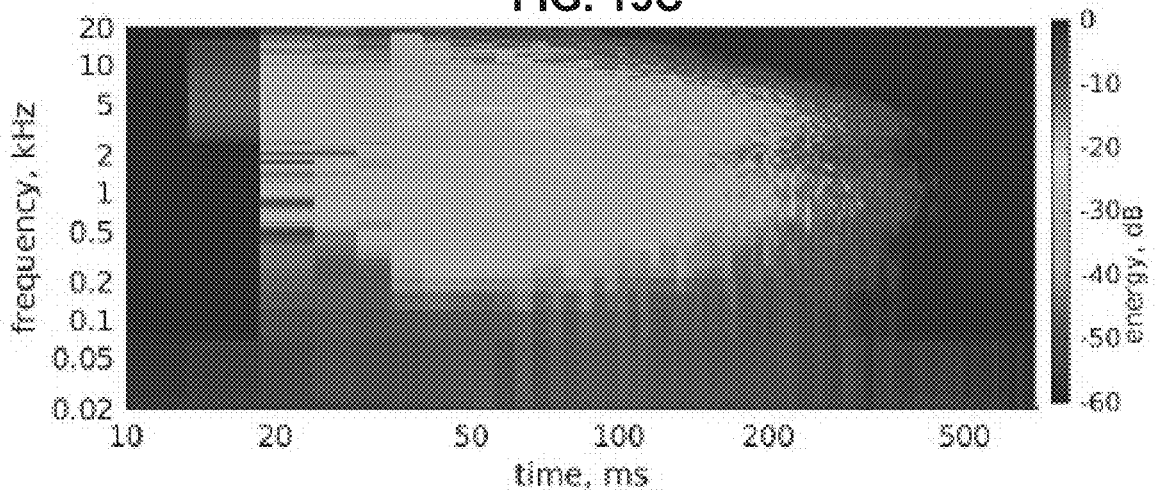

FIGS. 13A to 13C illustrate corresponding spectrograms for the measurements illustrated in connection with FIGS. 11 and 12 described above. More particularly, the loudspeaker-microphone impulse response spectrogram is shown in FIG. 13A along with the root mean square canceler residual for the unoccupied CCRMA Stage in FIG. 13B and occupied CCRMA Stage in FIG. 13C. Note that a substantial amount of the loudspeaker energy has been canceled, particularly at the impulse response beginning and for frequencies below about 2 kHz. Overall, the residual simulated acoustics energy present in the room signal estimate $\hat{d}(t)$ was a little over 20 dB for the occupied CCRMA Stage, and slightly more than 22.5 dB for the unoccupied CCRMA Stage.

Figure 14A:
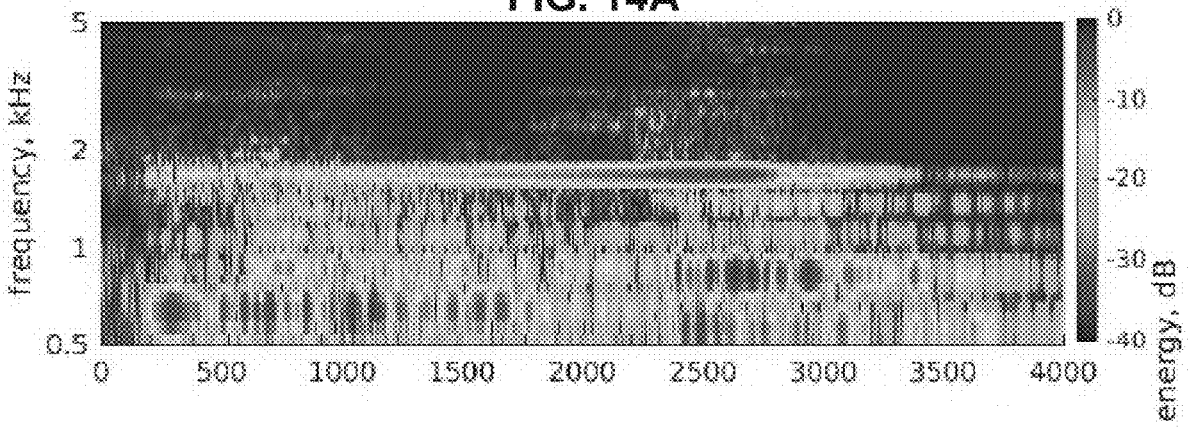
FIGS. 14A and 14B are spectrograms illustrating an example performance of feedback cancellation in accordance with embodiments.
Figure 14B:
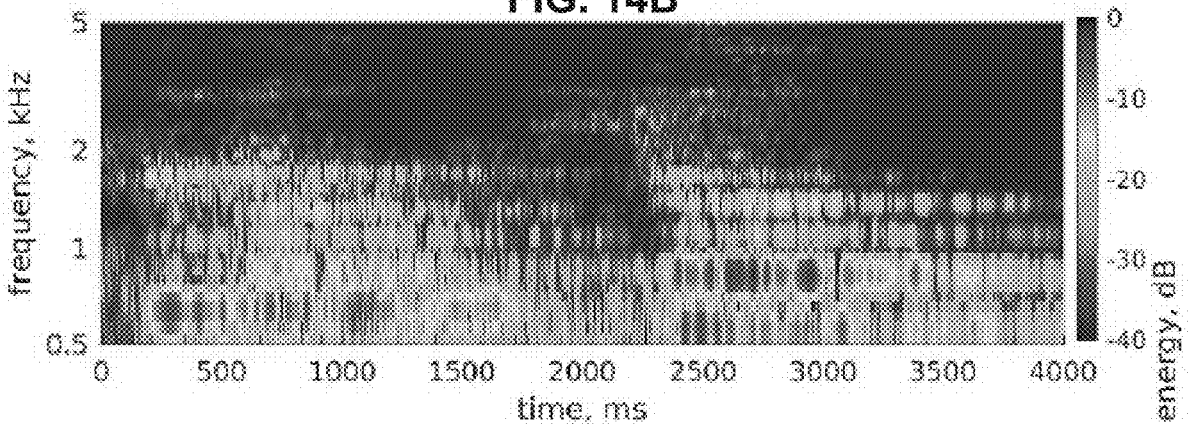

An example of the ability of a system according to embodiments to suppress feedback resulting from creating a reverberant synthetic acoustic environment is described with reference to FIGS. 14A and 14B. More particularly, FIG. 14B shows a spectrogram of a recording of the inventive system operating in a small room simulating Stanford Memorial Church. Meanwhile, FIG. 14A shows a spectrogram of the same segment, but with the canceler component of the system switched off at about 500 ms, and then switched back on at about 3000 ms. Note the rapid build-up and subsequent suppression of feedback near 1800 Hz with the temporary removal of the cancellation processing.

Although the present embodiments have been particularly described with reference to preferred examples thereof, it should be readily apparent to those of ordinary skill in the art that changes and modifications in the form and details may be made without departing from the spirit and scope of the present disclosure. It is intended that the appended claims encompass such changes and modifications.

What is claimed is:

1. A system for reducing feedback resulting from a sound produced by a speaker being captured by a microphone, the sound including auralization effects, the system comprising:

an auralizer for producing the auralization effects; and a canceler, wherein the canceler includes a cancellation filter that is based on an impulse response between the microphone and the speaker, and wherein the impulse response is formed according to acoustics of a live acoustic space in which the microphone and the speaker are separately placed, and wherein the acoustics include at least an acoustic propagation delay between the speaker and the microphone.

2. The system of claim 1, wherein the cancellation filter is calibrated based on relative positions of the microphone and the speaker in the live acoustic space.

3. The system of claim 1, wherein the microphone is one of a plurality of microphones, and wherein the speaker is one of a plurality of speakers, and wherein the cancellation filter is based on impulse responses between each microphone-speaker pair of the plurality of microphones and the plurality of speakers.

4. The system of claim 1, wherein the auralization effects include artificial reverberation.

5. The system of claim 4, wherein the artificial reverberation is performed in accordance with a target acoustic space that is different from the live acoustic space.

6. The system of claim 1, wherein the microphone further captures live sound, the canceler being operative to reduce feedback caused by the acoustics of the live acoustic space before the live sound is processed by the auralizer and output to the speaker as the sound with the auralization effects.

7. The system of claim 1, wherein the auralizer and the canceler are implemented by a digital audio workstation.

8. A method for reducing feedback resulting from a sound produced by a speaker being captured by a microphone, the sound including auralization effects, the system comprising:

capturing live sound by the microphone; and performing cancelation on the live sound using a cancellation filter that is based on an impulse response between the microphone and the speaker, the cancelation resulting in a live sound estimate, and wherein the impulse response is formed according to acoustics of a live acoustic space in which the microphone and the speaker are separately placed, and wherein the acoustics include at least an acoustic propagation delay between the speaker and the microphone.

9. The method of claim 8, further including adding the auralization effects to the live sound estimate and providing the live sound estimate with the added auralization effects to the speaker.

10. The method of claim 8, wherein the cancellation filter is calibrated based on relative positions of the microphone and the speaker in the live acoustic space.

11. The method of claim 8, wherein the microphone is one of a plurality of microphones, and wherein the speaker is one of a plurality of speakers, and wherein the cancellation filter is based on impulse responses between each microphone-speaker pair of the plurality of microphones and the plurality of speakers.

12. The method of claim 9, wherein adding the auralization effects includes performing artificial reverberation.

13. The method of claim 12, wherein the artificial reverberation is performed in accordance with a target acoustic space that is different from the live acoustic space.

14. A method for reducing feedback resulting from a sound produced by a speaker being captured by a microphone, the sound including auralization effects, the method comprising:

generating a live sound without auralization effects from the speaker in a live acoustic space;

capturing the live sound by the microphone;

measuring an impulse response between the microphone and the speaker using the captured live sound; and using the measured impulse response to obtain characteristics of a cancellation filter wherein the cancellation filter is configured to reduce effects of at least acoustics of a live acoustic space in which the microphone and the speaker are separately placed, and wherein the acoustics include at least an acoustic propagation delay between the speaker and the microphone.

15. The method of claim 14, wherein the measured impulse response is a function of frequency and time.

16. The method of claim 14, wherein the characteristics of the cancellation filter further include a windowing function.

* * * * *